US006134932A

United States Patent [19]

Marque et al.

[11] Patent Number: 6,134,932

[45] Date of Patent: Oct. 24, 2000

[54] MACHINE FOR BENDING OR CAMBERING A PROFILE SECTION, AND BENDING HEAD THEREFOR

[75] Inventors: Laurent Marque, Saint-Georges; Philippe Jaubert, Cologne, both of France

[73] Assignee: Robolix, Cologne, France

[21] Appl. No.: 09/171,022

[22] PCT Filed: Apr. 8, 1997

[86] PCT No.: PCT/FR97/00621

§ 371 Date: Oct. 9, 1998

§ 102(e) Date: Oct. 9, 1998

[87] PCT Pub. No.: WO97/37785

PCT Pub. Date: Oct. 16, 1997

[30] Foreign Application Priority Data

Apr. 10, 1996 [FR] France ..... 96 04642

[51] Int. Cl.[7] ..... B21D 7/04; B21D 9/05

[52] U.S. Cl. ..... 72/149; 72/153

[58] Field of Search ..... 72/149, 150, 154, 72/155, 157, 158, 159

[56] References Cited

U.S. PATENT DOCUMENTS

| | | | |
|---|---|---|---|
| 4,765,168 | 8/1988 | Stange et al. | 72/159 |
| 5,495,740 | 3/1996 | Schwarze | 72/158 |

FOREIGN PATENT DOCUMENTS

| | | |
|---|---|---|
| 0 561 025 | 9/1993 | European Pat. Off. . |
| 2150503 | 4/1973 | France . |
| 28 16 862 | 9/1979 | Germany . |
| WO 87/00096 | 1/1987 | WIPO . |

*Primary Examiner*—Rodney A. Butler
*Attorney, Agent, or Firm*—Young & Thompson

[57] ABSTRACT

A machine for bending or cambering a profile has two bending rollers mounted on a tool holder carriage, a block for supporting the tool holder carriage with respect to which the latter is pivotably mounted about a rotational axis coaxial with the axis of one of the bending rollers, the supporting block being pivotably mounted with respect to the frame of the machine about a rotational axis coaxial with the axis of the other bending roller; with the ability to rotationally lock either the tool carriage holder to the supporting block or the supporting block to the frame, and the ability to pivot in reverse directions the tool holder carriage/supporting block assembly or the tool holder carriage.

15 Claims, 10 Drawing Sheets

31
24
18

C
7
13
11
22
21
15
23
31
24
18
6
12
26
25
16
E

D
7
13
35
34
1
6
12

31
24
18

C
C
7
6
13
14
11
22
15
21
23
12
26
25
16
E
E
31
24
18

35
D
D
13
7
1
34
12
6

31
24
18
13
14
11
22
15
21
23
7
6
C
E
26
25
16
12
35
34
1
D

MACHINE FOR BENDING OR CAMBERING A PROFILE SECTION, AND BENDING HEAD THEREFOR

BACKGROUND OF THE INVENTION

1. Field of the Invention

The invention concerns a machine for bending or cambering a profile such as a rod, tube, bar, wire or the like. It also concerns a bending head designed to be fitted to such a machine.

2. Description of the Related Art

Current bending machines conventionally comprise a frame on which are mounted bending means having clamping jaws and a bending form provided with supporting surfaces between which the profile passes, is clamped and is then wound, the bending means being mounted on a bending head able to pivot about an axis coaxial with the axis of the bending form. In addition, these bending machines generally include a guide strip positioned upstream from the clamping jaws and a straightening element positioned upstream from the bending form. Finally, they include means for moving the profile longitudinally relative to the frame.

The main disadvantage of these bending machines lies in the fact that they only allow profiles to be bent to one side, either to the right or to the left. In addition, the positioning assembly of the clamping jaws and the assembly for moving the guide strip produce an overall size which limits the geometry of the final parts bent.

With a view to overcoming the relative disadvantage relating to one-way bending, three main types of bending machine exist at present.

First of all, a first solution consists of providing bending machines with a numerically controlled clamp adapted so as to turn the profile about its axis with a view to changing the bending direction. However, such bending machines have a first disadvantage resulting from the fact that, when changes are made to the bending direction, movements of the profile produce so-called "whiplash" phenomena which are in particular liable to alter adversely the shape of the part produced.

A second solution consists of producing bending machines provided with means for driving the bending head in rotation which are able to turn the latter about the profile.

A third solution finally consists of producing bending machines provided with a double bending head associated with means for driving this bending head in rotation about itself. However, this solution leads to the production of relatively complex bending machines and hence to a high cost.

Moreover, in a general manner, and whatever the technique adapted from among the solutions described above, all current bending machines have two major disadvantages added to those referred to above. In point of fact, and first of all, on account of their design, they all generate an overall size which limits the geometry of the final bent parts. In practice, for example, such bending machines make it difficult to produce complex pieces having in particular consecutive 180° bends forming S bends. Moreover, the cycle times of these bending machines are relatively long, leading to a low production rate.

Two other types of machine, described respectively in patents FR 2.150.503 and EP 561.025 have been developed with a view to permitting cranking in two directions.

First of all, the machine described in patent FR 2.150.503 principally comprises:

a cylindrical chuck holder associated with a tooth wheel carrying two horizontal shafts equidistant from the axis of the chuck holder, each of these shafts carrying a roller and resting in cradles secured to the frame, a system of chains and sprockets operated by jacks, provided to cooperate with the toothed wheel so as to cause the chuck holder to pivot about the axis of one or other of the shafts housed in its cradle.

Such a machine, which effectively enables tubes to be cranked in two directions, has however several disadvantages. In point of fact, and first of all, the rate of rotation of the chuck holder is not linear since it depends on the positions in which the jacks are deployed. On account of this, the precision of the cranks becomes altered adversely and is difficult to manage. Moreover, such a machine does not enable bending operations to be carried out, namely operations where the tubes are gripped and then rolled between the rollers, but simply flexing operations. Finally, the flexing assembly (chuck holders etc) is held overlapping and resting against the frame by the system of chains and sprockets associated with the jacks. On account of this, any failure in the supply circuit to these jacks leads to a reduction in the supply pressure of the latter and may lead to the flexing assembly being detached and hence to risks of damage to the latter and especially risks of injury to the personnel using it.

As regards the machine described in patent EP 561 025, this principally comprises:

a disc rotating about its axis of revolution, provided with an axial guide groove, a slider able to move in translation in the groove, two rollers with a fixed inter-axial distance arranged symmetrically either side of the axis of rotation of the disc, between the slider and a part of the frame, and a double indexing means able to lock alternately one of the rollers to the slider and the other roller to the fixed part of the frame.

According to this patent, as the disc rotates, the slider is caused to move in the groove of said disc, causing the roller secured to this slider to pivot about the fixed roller.

Such a machine also enables tubes to be cranked in two directions, but also has several disadvantages. Indeed, and first of all, its flexing head is relatively bulky (minimum overall size equal to four times the diameter of the rollers) which leads to a limitation of the complexity of shapes which can be produced. Moreover, since the inter-axial distance between the rollers has to be fixed, such a machine only allows flexing operations to be achieved and not bending operations. Finally, mechanically, such a machine is subject to problems of slipping and jamming of the slider inside the groove, which leads to the necessity of exerting high forces which can result in rapid deterioration of the mechanical parts.

SUMMARY OF THE INVENTION

The present invention aims at overcoming all the disadvantages referred to above of current bending or cambering machines and its main objective is to provide a machine with a very simple design enabling bends to be produced in both directions at very high production rates allowing parts to be produced having a complex geometry.

Another objective of the invention is to provide a bending or cambering machine of which the bending head has a small overall size and constitutes an interchangeable head leading to an appreciable reduction in adjustment times.

To this end, the invention concerns a bending or cambering machine comprising:

two bending rollers mounted on a tool holder carriage and provided with supporting surfaces between which the profile to be bent passes, is gripped and is then rolled, a supporting block for the tool holder carriage in relation to which the latter is pivotably mounted about an axis of rotation coaxial with the axis of one of the bending rollers, said supporting block being mounted pivotably with respect to the frame of the machine about an axis of rotation coaxial with the axis of the other bending roller, indexing means able to lock rotationally, either the tool holder carriage to the supporting block, in a so-called left hand bending state, or the supporting block to the frame, in a so-called right hand bending state, rotational drive means able to pivot the tool holder carriage/supporting block assembly in a first direction of rotation in the left hand bending state of the indexing means and to pivot the tool holder carriage in a direction of rotation opposite to the first direction of rotation in the right hand bending state of the indexing means.

The bending or cambering machine according to the invention thus enables a profile to be bent very easily in both directions, the only operation to be carried out with a view to changing the bending direction consisting of controlling the movement of the indexing means. A machine of this type thus allows very high flexing rates to be achieved, and on account of its very simple design, leading to a small-size bending head, enables parts to be produced having complex shapes, in particular bends cranked through 180° in an S shape.

Moreover, it should be noted that in the case where the bending assembly is fitted to a machine which enables this assembly to be turned in a conventional manner around the profile with a view to producing multidirectional bending, this profile remains fixed in rotation and the risks of "whiplash" are thus limited.

According to another feature of the invention:

the supporting block is pierced with two bores passing through it, coaxial to the axes of the bending rollers, the tool holder carriage is carried by a rotating shaft extending into one of the bores of the supporting block and provided, at its end opposite said tool holder carriage, with a rotational drive pinion, the supporting block is attached to the frame via a shaft extending into the second bore of said supporting block and mounted in bearings secured to said frame, said shaft being provided with a rotational drive pinion, the respective rotational drive means of the tool holder carriage/supporting block assembly and of the tool holder carriage are adapted so as to drive pinions of the previously mentioned shafts in rotation.

In addition, the pinions of the rotating shafts are preferably arranged so as to intermesh, and the rotational drive means include a toothed wheel arranged so as to mesh with the pinion of the rotating shaft of the supporting block. In this way, the bending machine includes a single drive motor arranged so that flexing can occur in both directions.

According to another feature of the invention, the indexing means comprise a finger housed in a bore provided in the supporting block, and means for moving said finger able to engage it either with the tool holder carriage or with a part secured to the frame.

In addition, the bending machine preferably includes two guide strips positioned upstream from the gripping rollers and provided with supporting surfaces between which the profile to be bent passes, said guide strips being associated with means for longitudinal movement and adapted to fulfil alternately a straightening function or a guiding function, according to the bending direction.

With a view to producing bends over small radii and/or with profiles having a thin wall, the guide strips may also advantageously be adapted to provide gripping of the profiles. In this case, moreover, the means for moving these guide strips longitudinally are adapted to exert a thrusting force capable of compressing the profile as the latter is moved in translation as a result of the pivoting of the bending rollers. This arrangement has the result in point of fact of maintaining most of the wire of the profile in compression and thus of preventing deformations thereof.

According to another feature of the invention, the bending machine includes means for the transverse movement of the guide strips capable of moving them transversely relative to the longitudinal axis of the profile between a closed position where said guide strips fulfil their straightening or guiding function, and a separated position where said guide strips are held apart by a distance adapted so as to remain supporting the profile, or to permit the passage of the means for moving the profile.

This arrangement enables the profile to be constantly supported directly upstream from the bending rollers.

Moreover, when the means for moving the profile longitudinally include conventionally a clamp able to grip the rear end of said profile, the bending machine advantageously includes, with a view to ensuring that this profile is supported and guided, two devices for guiding and holding the profile positioned either side of the axis of movement of said profile upstream from the bending rollers, said guiding and holding devices being associated with elastic means able to cause them to retract transversely in contact with the clamp.

In addition, each guide strip is preferably provided with a spigot housed in a clevis inside which are disposed elastic means provided to tension said spigot so as to allow travel of said guide strip either side of a plane passing through the longitudinal axis of movement of the profile.

This arrangement leads, in point of fact, to auto-centering of the guide strips to be obtained relative to the profile and this without requiring precise adjustment to be made, which is always a delicate operation to make in order to obtain the position of said guide strips.

According to another feature of the invention:

the bending rollers have at least two grooves, one above the other, each one adapted to deform profiles with different cross sections and/or non-circular cross sections, possibly through different radii, vertical means for moving the supporting block adapted so as to position the latter in such a way that one or other of the grooves of the bending rollers are disposed in a plane coplanar with the axis of movement of the profiles.

This arrangement makes it possible, without the need for any adjustment whatsoever, to bend a profile having two different and/or non-circular sections or successively two profiles having different and/or non-circular sections.

Moreover, the vertical means for moving the supporting block are adapted so as to position the latter in a supplementary so-called retracted position, where the bending rollers are disposed so as to allow said bending rollers to rotate relative to the profile.

The fact of being able to dispose the supporting block in this lower retracted position makes it possible to pivot the latter or the tool holder carriage, once bending has been carried out, whilst simultaneously moving the profile longitudinally, and therefore leads to an appreciable gain in time.

According to another feature of the invention, the supporting block is pivotably mounted with respect to the wings of a clevis-shaped part forming with said supporting block a bending head, the frame of said bending machine including detachable means for securing said bending head.

This detachable character of the bending head makes it possible, by virtue of the small overall size of the latter, to bend profiles of various cross sections on the same machine without having to carry out delicate adjustments to the tooling which current bending machines require.

Moreover, the detachable means of securing the bending head preferably include two crank pins associated with means for longitudinally moving said crank pins relative to the frame of said machine, adapted so as to press the core of the clevis of said bending head against said frame, and means for rapidly connecting fluids and electricity.

In addition, the clevis of the bending head advantageously has a core with a thickness which is a function of the distance between the axes of the pinions of the rotating shafts, adapted so that the pinion of the rotating shaft of the supporting block meshes with the toothed wheel secured to the frame.

The invention extends to a bending head adapted so as to be mounted in a removable manner on the frame of a bending machine, comprising:

two bending rollers mounted on a tool holder carriage and provided with supporting surfaces between which the profile to be bent passes, is gripped and is then rolled, a supporting block for the tool holder carriage with respect to which the latter is pivotably mounted about an axis of rotation coaxial with the axis of one of the bending rollers, said supporting block being pivotably mounted about an axis of rotation coaxial with the axis of the other bending roller, inside a clevis-shaped part able to be secured in a removable manner to the frame of the machine, indexing means capable of locking in rotation either the tool holder carriage to the supporting block, in a so-called left hand bending state, or the supporting block to the clevis-shaped part in a so-called right hand bending state, rotational drive means capable of pivoting the tool holder carriage/supporting block assembly in a first direction of rotation, in the left hand bending state of the indexing means, and to pivot the tool holder carriage in the reverse direction of rotation to the first direction of rotation, in the right hand bending state of the indexing means.

BRIEF DESCRIPTION OF THE DRAWINGS

Other characteristics, aims and advantages of the invention will become apparent from the following detailed description with reference to the accompanying drawings in which a preferred embodiment is represented by way of a non-limiting example. In these drawings which form an integral part of the present description.

Figure 6C:
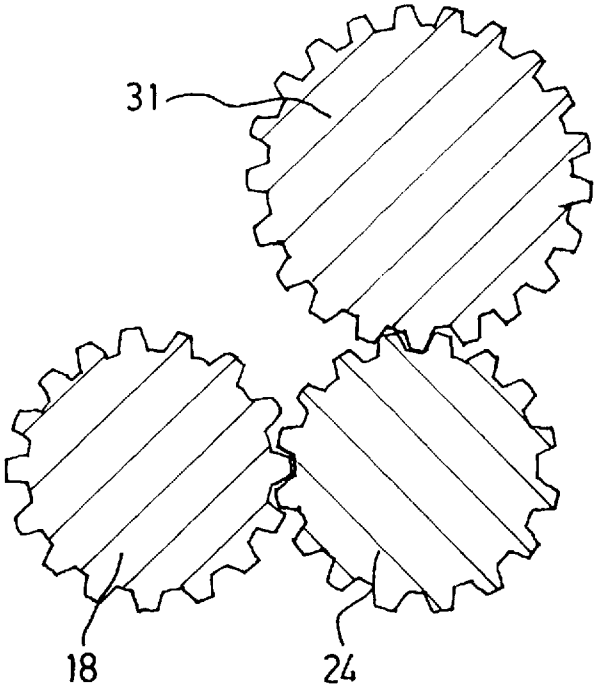
FIGS. 6, 7 and 8 illustrate diagrammatically the successive left hand bending phases of a profile by means of a bending machine according to the invention, represented respectively.
Figure 6B:
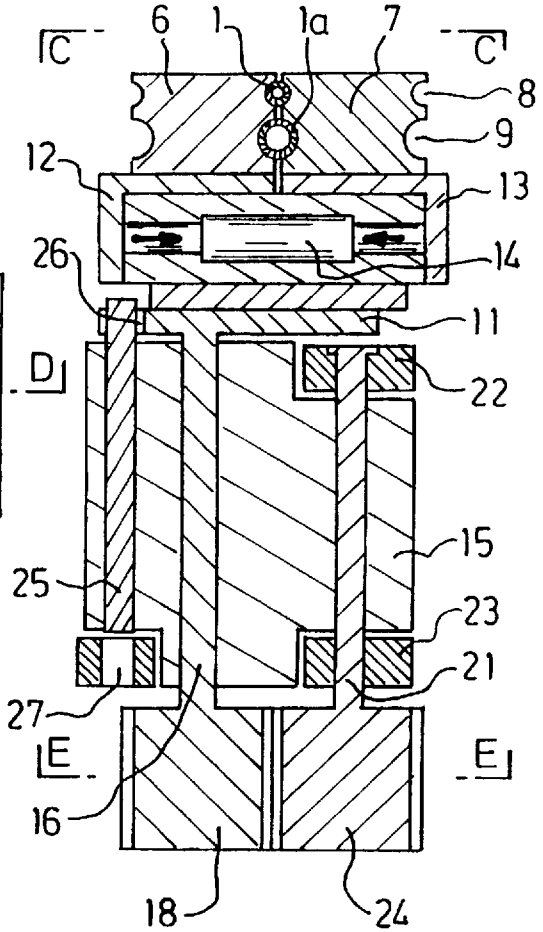
Figure 6A:
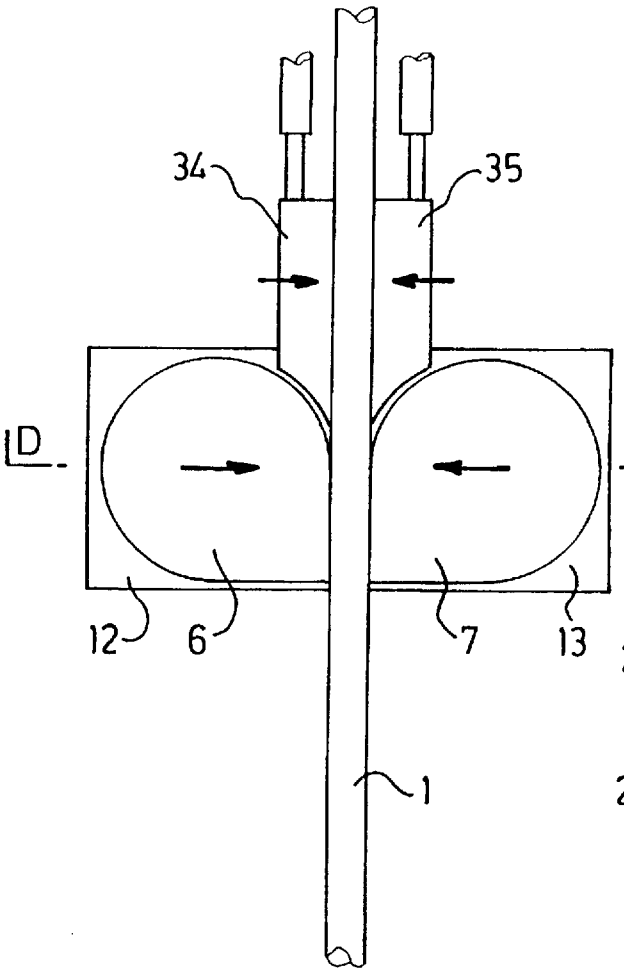
Figures 7A, 7B, 7C:
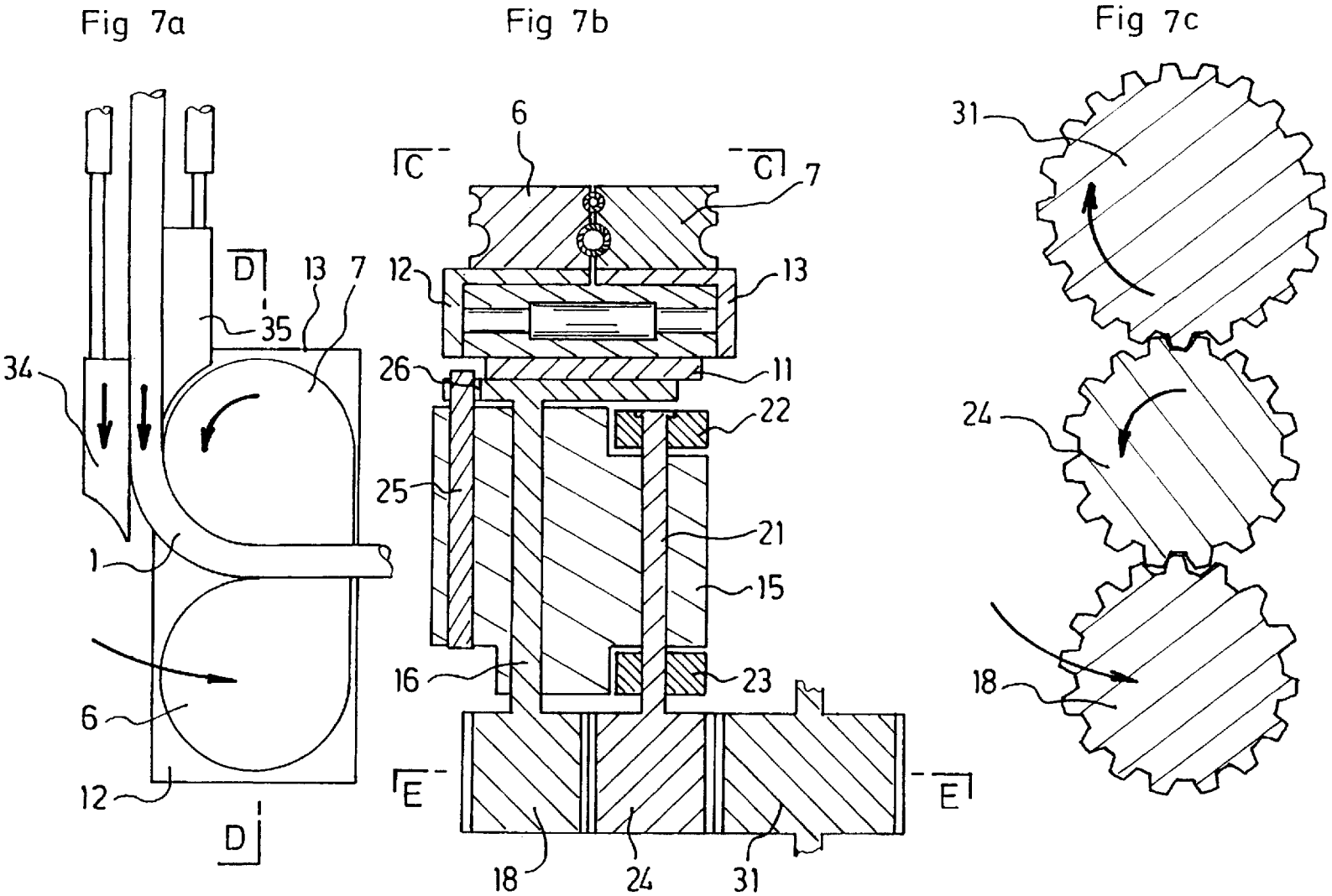
Figures 8A, 8B, 8C:
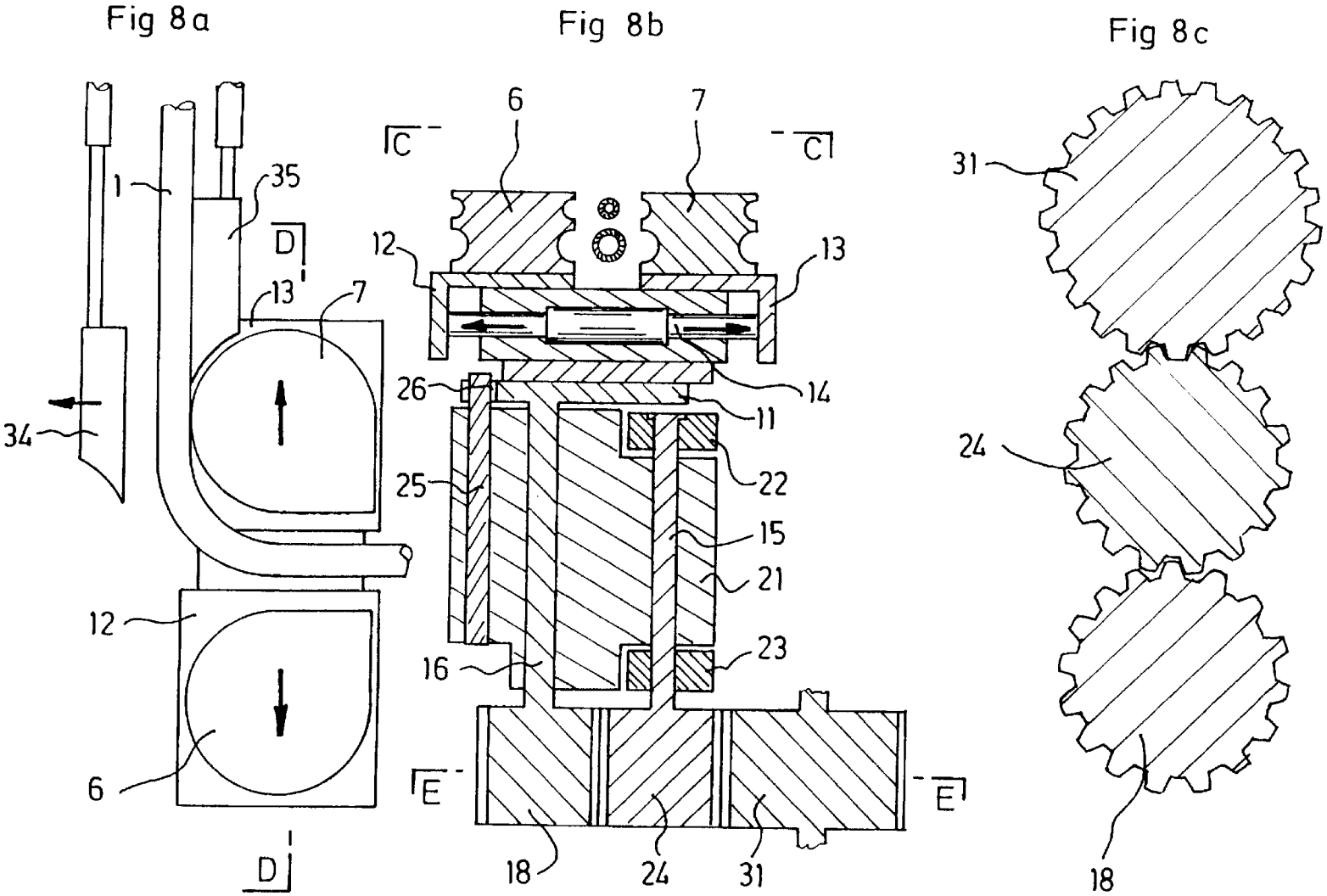

in a view from above according to the view C for FIGS. 6*a*, 6*b* and 6*c*, in a vertical section through a plane D for FIGS. 7*a*, 7*b* and 7*c*, in a horizontal section through a plane E for FIGS. 8*a*, 8*b*, 8*c*, and the FIGS. 9*a*, 9*b*, 9*c*, 10*a*, 10*b*, 10*c* and 11*a*, 11*b*, 11*c* are diagrams corresponding to the preceding figures when a profile is bent to the right.

DESCRIPTION OF THE PREFERRED EMBODIMENTS

The bending machine shown by way of example in FIGS. 1 to 4 is adapted so as to ensure the bending of tubes 1. In a conventional manner, it includes a frame 2 on which are mounted the bending means described below and a clamp 3 able to grip the rear end of the tube, said clamp being housed inside a cylindrical channel 4 and associated with drive means (not shown) able to move it longitudinally relative to the frame 2.

In addition, and in a conventional manner, this bending machine may be provided either with means for driving the clamp 3 in rotation about its longitudinal axis, or means for driving the frame 2 in rotation about the clamp 3, and this with the aim of producing multidirectional bends.

In the first place, this bending machine has the characteristic of possessing a bending head 5 adapted so that it can be fixed in a detachable manner to the frame 2. This bending head 5 includes, first of all, two bending rolls 6, 7 in a conventional form each provided with two grooves 8, 9 positioned one above the other enabling tubes 1 of different diameters to be deformed, such as for example a tube with a given diameter and the same tube 1 covered with a sheath 1*a*.

These bending rollers 6, 7 are carried by a tool holder carriage 10 consisting of a platen 11 and two jaws 12, 13 on each of which one of said bending rollers is secured, each associated with a jack such as 14, which can allow them to be moved transversely relative to the axis of movement of the tube 1.

The tool holder carriage 10 is itself carried by a supporting block 15 with respect to which it is mounted so as to rotate about an axis coaxial with the axis of one of the bending rollers 6.

To this end, the platen 11 of this tool holder carriage 10 is secured to a rotating shaft 16 extending into a traversing bore provided in the supporting block 15 inside which roller bearings such as 17 are disposed. In addition, this rotating shaft 16 is provided with a pinion 18 at the level of its lower end.

As regards the supporting block 15, this is mounted inside a clevis-shaped part 19 with respect to which it is arranged so as to be able to turn about an axis of rotation coaxial with the axis of the second bending roller 7.

To this end, this supporting block 15 is provided with a second traversing bore inside which roller bearings such as 20 are disposed, housing a rotating shaft 21 mounted so as to rotate in bearings 22, 23 secured to the wings 19*a*, 19*b* of the clevis-shaped part. In addition, this rotating shaft 21 is provided, at the level of its lower end, with a pinion 24 arranged so as to mesh with the pinion 18 of the rotating shaft 16 of the tool holder carriage 10.

This bending head 5 additionally includes indexing means capable of locking either the tool holder carriage 10 to the supporting block 15, or this supporting block 15 to the clevis-shaped part 19.

Figure 3:
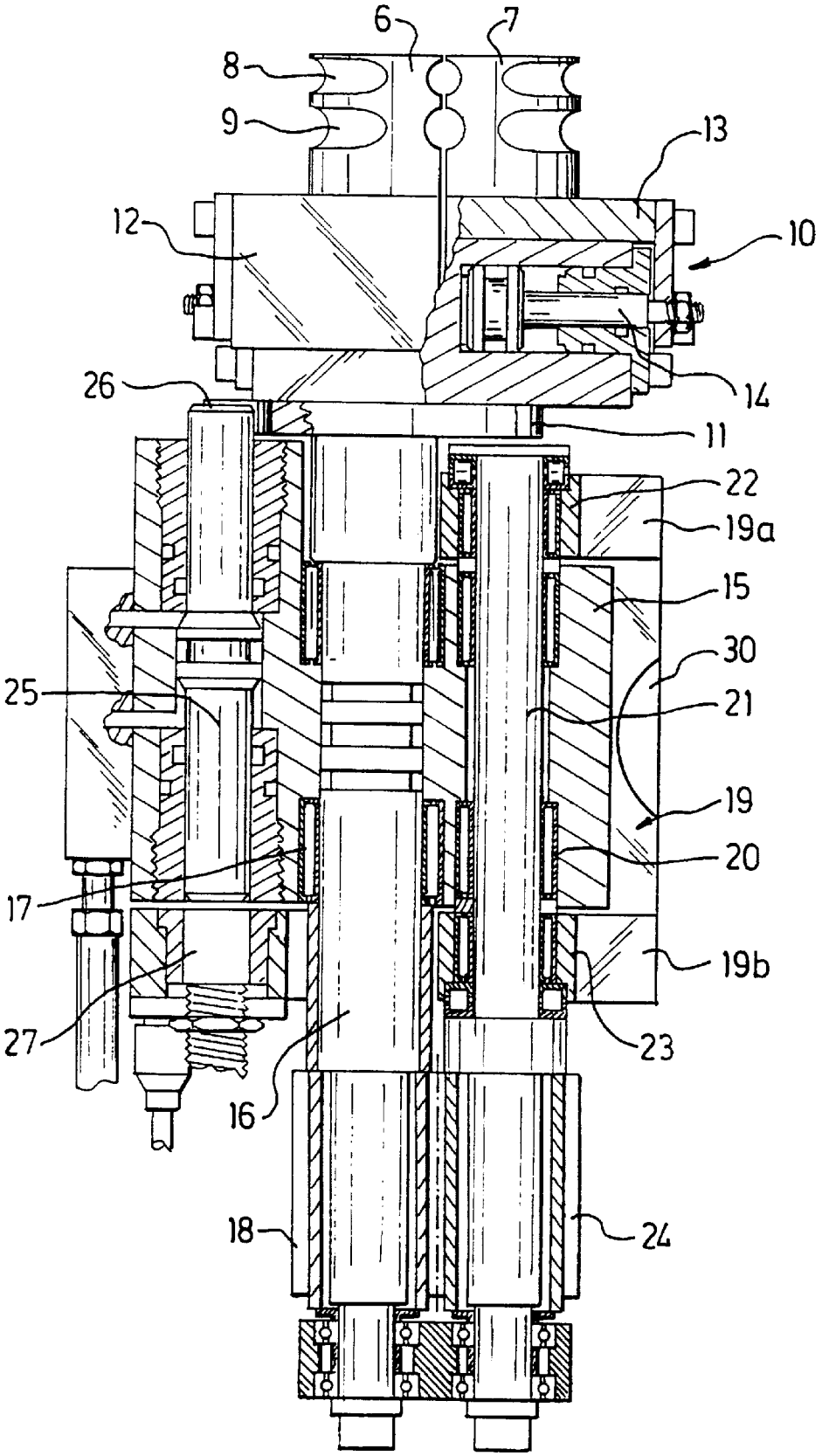
FIG. 3 is a transverse section through a vertical plane A of the bending head of this bending machine.

As shown in FIG. 3, these indexing means include a finger 25 housed in a third bore provided in the supporting block 15, hydraulically actuated so as to be housed, either in an orifice 26 provided in the platen 11 of the tool holder carriage 10, or in an orifice 27 provided in the lower wing 19*a* of the part 19.

Figure 1:
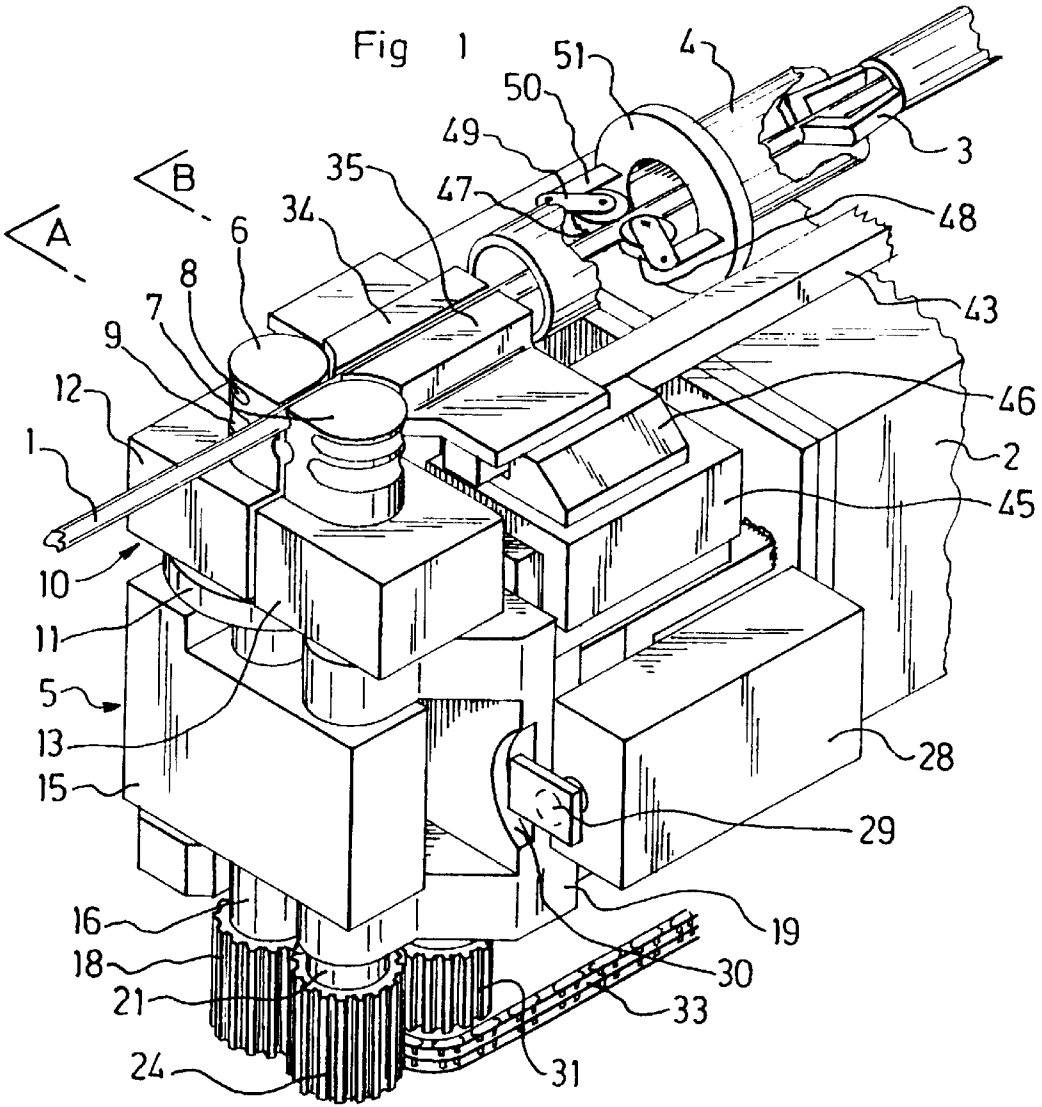
FIG. 1 is a partial perspective view of a bending machine according to the invention.

As shown in FIG. 1, the detachable means of securing this bending head 5 to the frame 2 comprise two hydraulic jacks such as 28 each carrying a crank pin 29 provided so as to be housed in a recess 30 provided in the core of the part 19 and thus to ensure the locking of the bending head 5 against the frame 2. In addition, devices for rapidly connecting fluids and electricity (not shown) are provided to enable the bending head 5 to be changed.

As regards the pivoting of the rollers 6, 7 of this bending head, this is obtained by means of a toothed wheel 31 mounted on a frame and actuated by means of a motor 32 and a chain transmission 33, said toothed wheel being arranged so as to mesh with the pinion 24 of the rotating shaft 21 of the supporting block 15.

It should be noted in this respect that since the distance between the axes of the pinions 18, 24, and hence the diameter of these pinions can differ from one bending head 5 to another, the thickness of the core of the part 19 of each bending head is adapted so that the pinion 24 of the rotating shaft 21 of the supporting block 15 meshes with the toothed wheel 31.

The bending machine additionally includes two guide strips 34, 35 able to ensure alternately either the function of a guide strip, that is to say for guiding the tube 1 with load bearing, or a straightening function.

Figure 4:
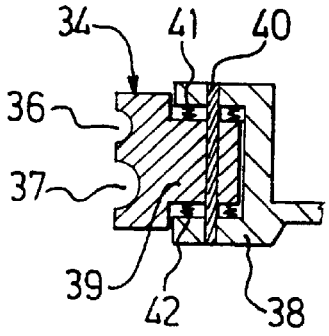
FIG. 4 is a partial transverse section through a vertical plane B, showing a guide strip of this bending machine.

As shown in FIG. 4, each of these guide strips 34, 35 includes two grooves 36, 37 positioned one above the other paired with those of the bending rollers 6, 7.

These guide strips 34, 35 are additionally mounted inside a clevis 38 and to this end have a spigot 39 which is housed in this clevis 38 and to which it is connected by means of a pin 40 allowing travel of said guide strips either side of a plane passing through the axis of the tube 1.

Moreover, springs such as 41, 42 are interposed between the spigot 39 and each of the wings of the clevis 38, so as to stabilize the guide strips 34, 35.

Each of these guide strips 34, 35 is additionally, in a conventional manner, mounted on a longitudinal rail 43 associated with a jack 44 enabling said guide strips to be moved longitudinally.

Moreover, this rail is itself mounted on a carriage 45 provided with a slide 46 for guiding said rail, each of said carriages 45 being associated with a jack (not shown) which can allow it to move transversely relative to the axis of movement of the tube 1.

The bending machine according to the invention also includes devices for guiding and holding the tube 1 disposed either side of the axis of movement of the latter, upstream from the bending rollers 6, 7.

These guiding and holding devices comprise, as shown in FIG. 1, two rollers 47, 48 each carried by an arm such as 49, extending through a slot provided in the channel 4 for guiding the clamp 3, said arms being mounted pivotably each on a lug such as 50 secured to a flange 51 mounted on the channel 4.

In addition, spiral springs (not seen on FIG. 1) disposed around the axis of rotation of the arms 49 and secured to the lugs 50 and said arms are adapted so as to hold the latter, in the absence of any pressure, in a position where they are substantially inclined to the rear with respect to the direction of movement of the tube 1.

Thus, the rollers 47, 48 hold and guide the tube 1 during its longitudinal movement, but retract transversely under the effect of the pressure of the clamp 3 when the latter comes into contact with said rollers.

Figure 2:
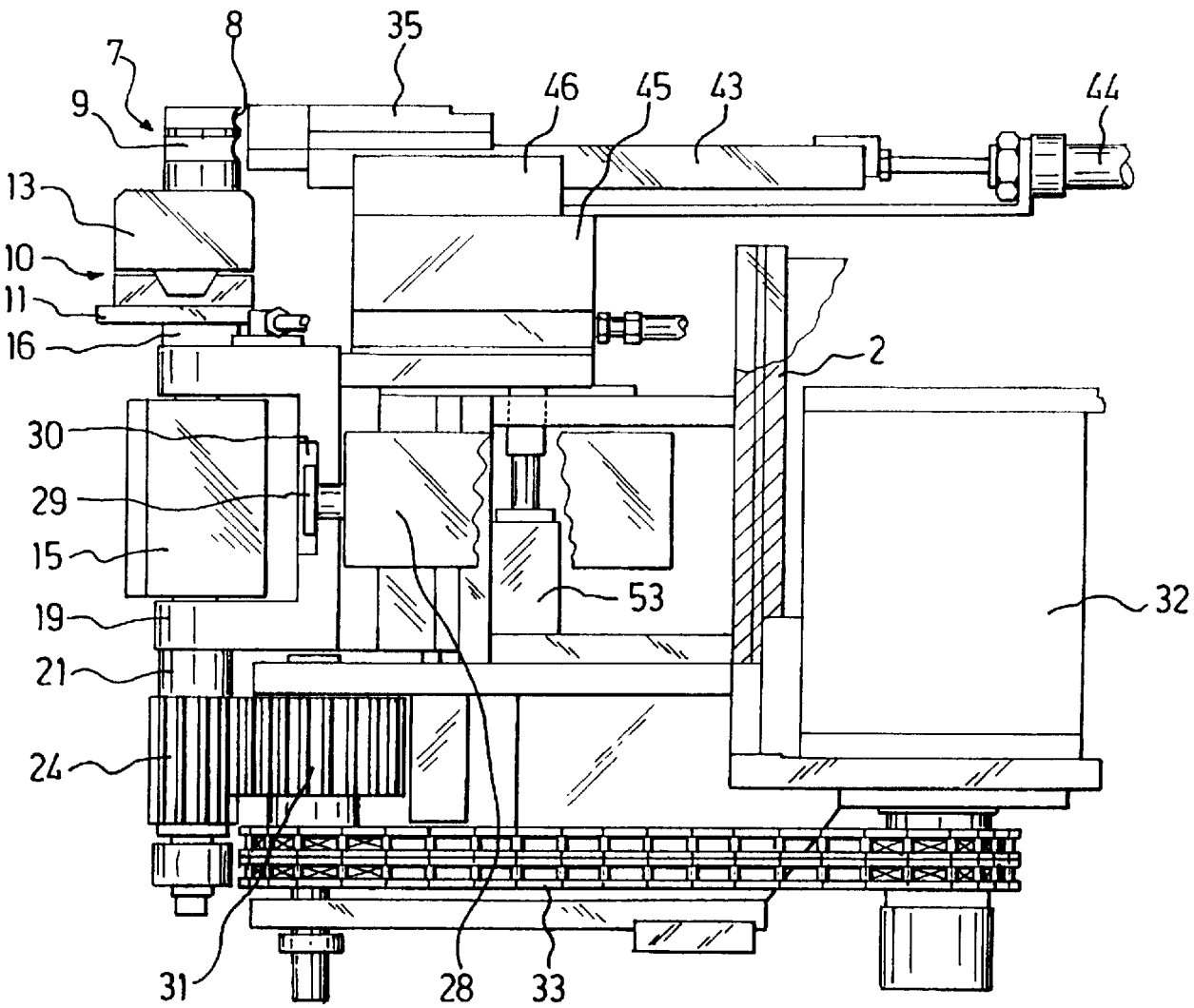
FIG. 2 is a side view of this bending machine.
Figure 5:
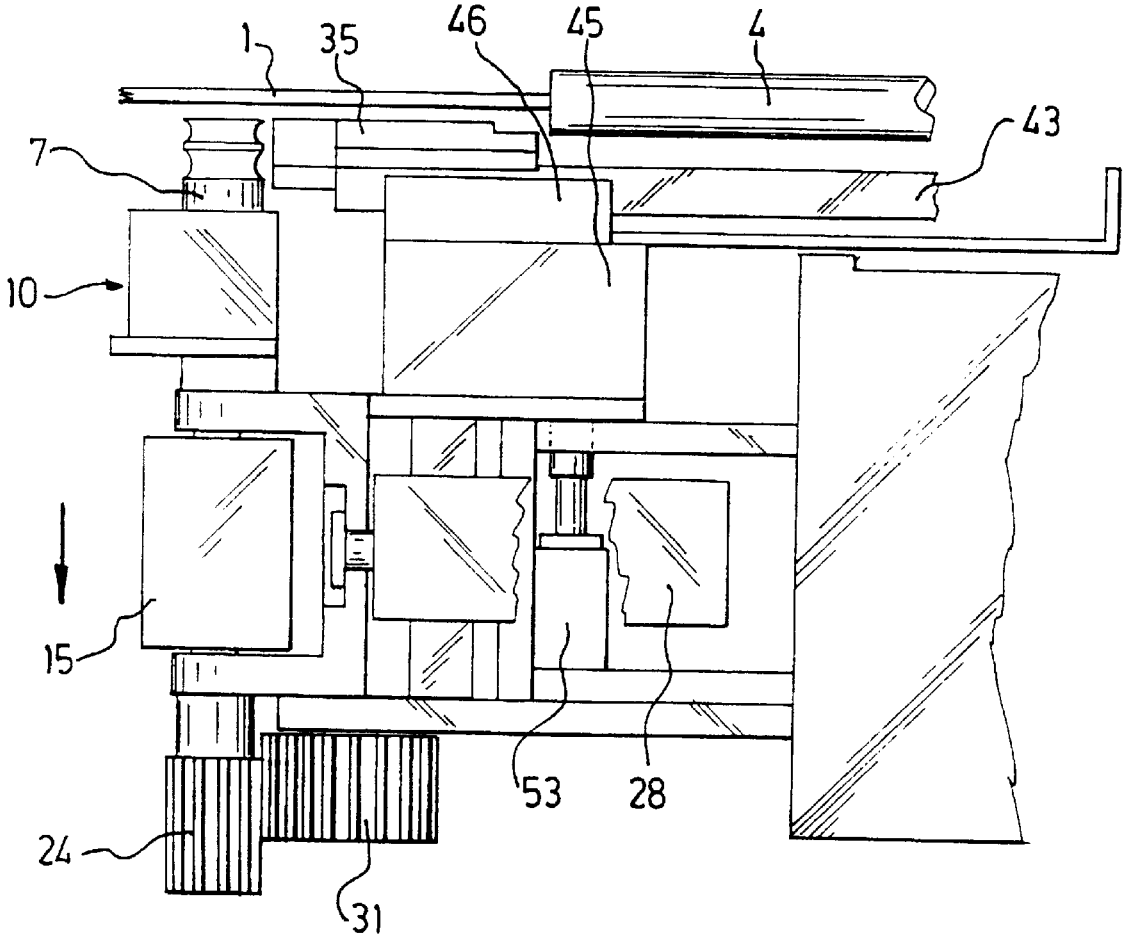
FIG. 5 is a diagrammatic side view of the bending machine according to the invention in its retracted position.

Finally, the bending head 5, the hydraulic jacks 28 and the carriages 45 holding the guide strips 34, 35 are mounted on a structure of the frame 2 able to move vertically, with reference to FIGS. 1 and 2 and supported by a jack 53 adapted so that said elements can move:

either so as to bring one or other of the grooves 8,9 of the bending rollers 6,7 into the same plane as the axis of longitudinal movement of the tube 1, or in a retracted position, shown in FIG. 5, where the bending head 5 is in a retracted position with respect to the tube 1, in which the bending rollers 6, 7 are situated below said tube, thus enabling said bending head to be pivoted simultaneously while moving the tube 1 longitudinally.

It should be noted that with a view to permitting vertical movements, the pinions 18, 24 of the rotating shafts 16, 21 of the bending head 5 have a height greater than that of the toothed wheel 31, adapted so as to keep the pinion 24 meshed with said toothed wheel, whatever the vertical position of said bending head.

The operation of the bending head according to the invention is explained below with reference to FIGS. 6 to 11.

First of all, with a view to bending the tube 1 to the left, the indexing finger 25 is disposed, as shown in FIG. 6*b*, so as to interlock rotationally the tool holder carriage 10 and the supporting block 15.

Moreover, as shown in FIG. 6*a*, the bending rollers 6, 7 and the guide strips 34, 35 are brought into their closed position where they grip the tube 1.

Bending is carried out by causing the toothed wheel 31 to turn clockwise. During this rotation, this toothed wheel 31 drives the pinion 24 anticlockwise. Moreover, since the supporting block 15 is rotationally interlocked with the tool holder carriage 10, the rotating shaft 21 is then also rotationally locked relative to said supporting block and rotation of the pinion 24 causes the tool holder carriage 10/supporting block 15 assembly to pivot about an axis coaxial with the axis of the bending roller 7 (FIG. 7*c*).

In addition, during this bending, the guide strip 34 is moved longitudinally, while the guide strip 35 acts as a straightening device. Finally, as shown in FIGS. 8*a* and 8*b*, once bending has been carried out, the bending rollers 6, 7 and the guide strip 34 are separated so as to release the tube 1, and the bending head 5 is retracted as appropriate before being caused to pivot in the opposite direction, so as to permit the tube 1 to move longitudinally before the bending following the latter one.

Figures 9A, 9B, 9C:
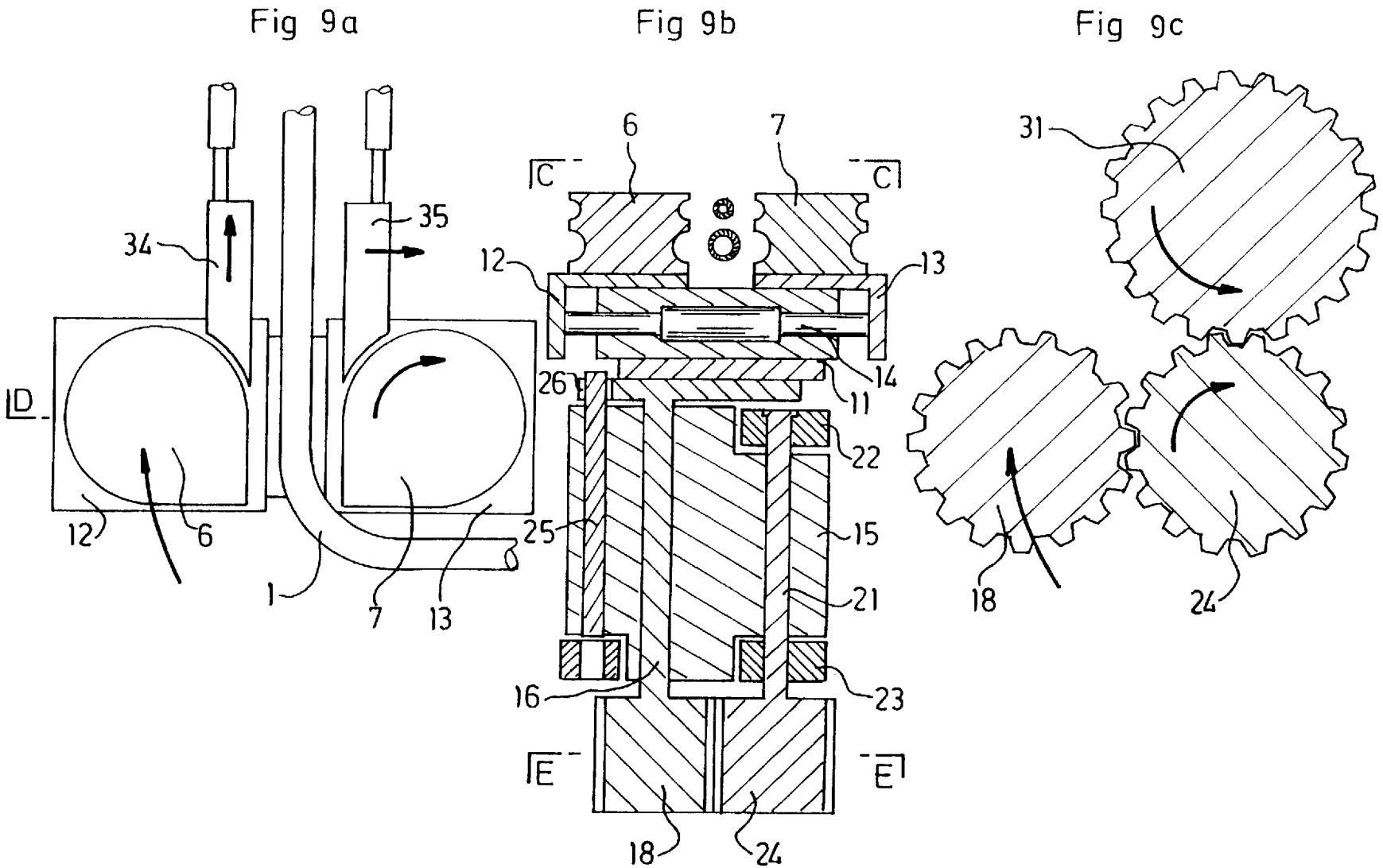

During this reverse pivoting shown in FIGS. 9*a* to 9*c*, obtained by causing the toothed wheel to turn anticlockwise, the guide strip 34 is conventionally brought to the rear. Finally, once pivoting has been carried out and the bending head 5 has been brought to its initial position, the guide strip 35 is separated transversely from the tube 1.

Figure 10C:
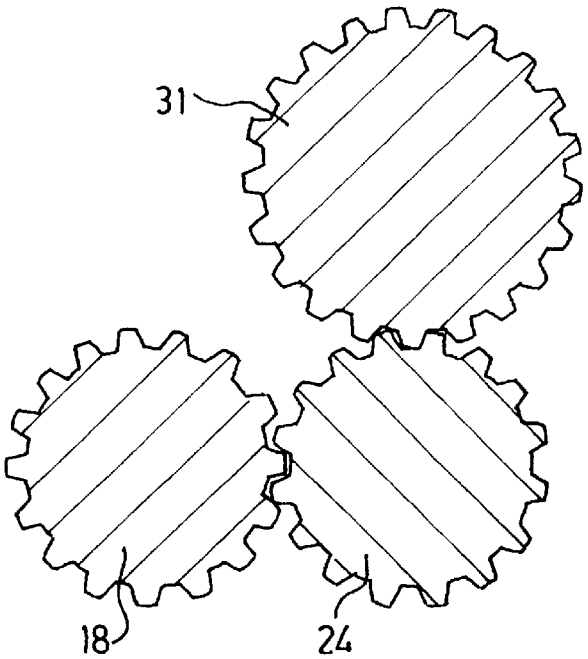
Figure 10B:
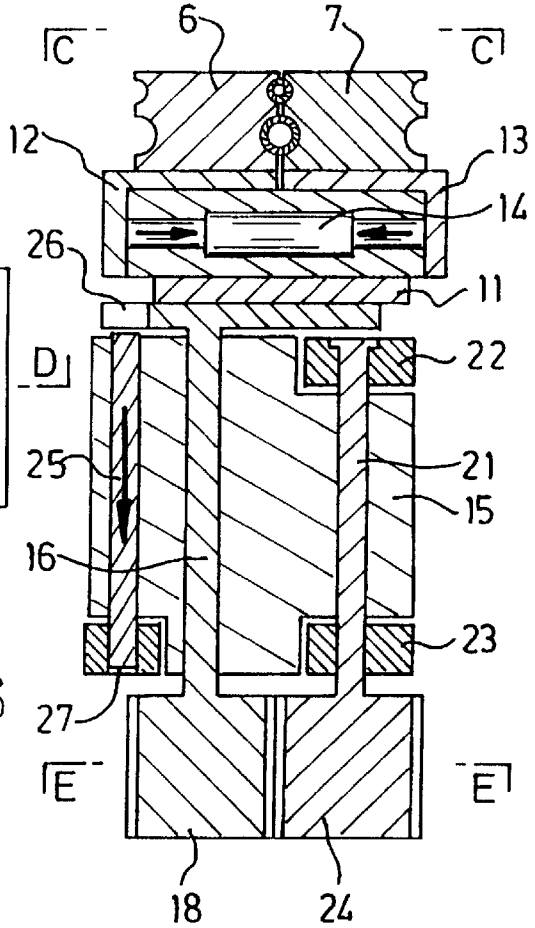
Figure 10A:
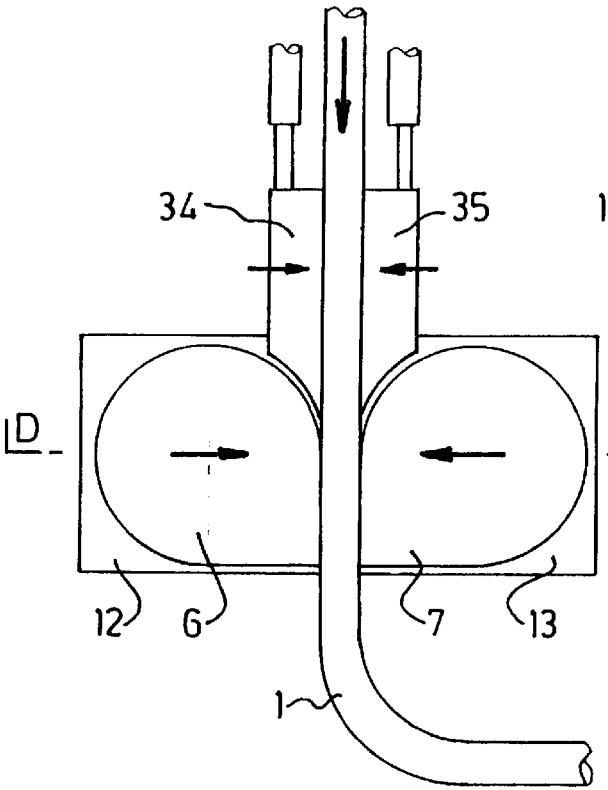

Secondly, with a view to bending the tube 1 to the right, the indexing finger 25 is disposed, as shown in FIG. 10*b*, so as to interlock rotationally the supporting block 15 and the clevis-shaped part 19.

Figure 11C:
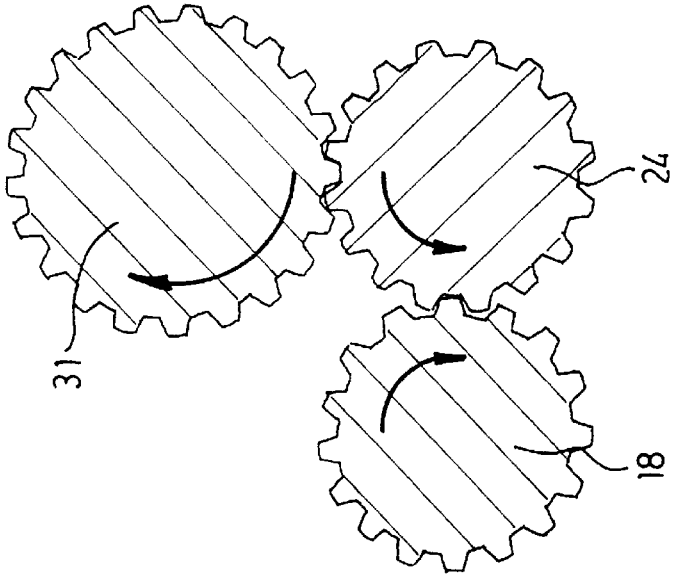
Figure 11B:
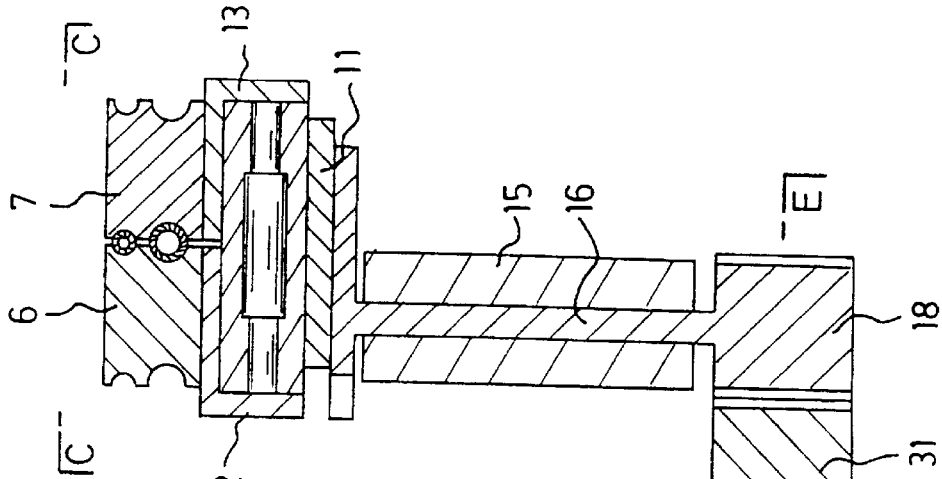
Figure 11A:
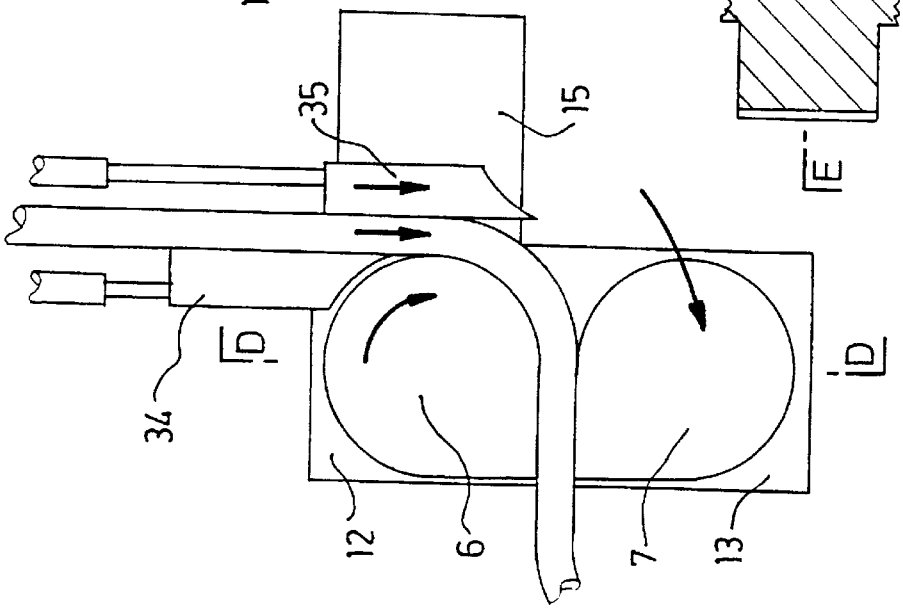

As a result of this, rotation of the toothed wheel 31 results in only the tool holder carriage 10 being pivoted, the supporting block 15 and hence its rotating shaft 21 being rotationally interlocked with the part 19 (FIGS. 11*b* and 11*c*).

In addition, in this case, the guide strip 35 is moved longitudinally, while the guide strip 34 acts as a straightening device.

As a result of the simplicity of the pivoting movements of the bending head 5, explained above, bending cycle times obtained with the bending machine according to the invention are very short, leading to a high production rate. Moreover, the small overall size of this bending head makes it possible to produce parts with a complex geometry.

What is claimed is:

1. A machine for bending or cambering a profile such as a rod, bar, tube, or wire, comprising:

a frame on which are mounted bending means, and means for moving the profile longitudinally relative to said frame, wherein the bending means of said bending machine comprises:

two bending rollers mounted on a tool holder carriage and provided with supporting surfaces between which the profile to be bent is passed, gripped, and rolled;

a supporting block for the tool holder carriage, wherein said tool holder carriage is pivotably mounted about an axis of rotation coaxial with an axis of one of the two bending rollers, said supporting block being pivotably mounted with respect to the frame of the machine about an axis of rotation coaxial with the axis of one of said two bending rollers;

an indexing means to lock in rotation either the tool holder to the supporting block in a left hand bending state, or to lock the supporting block to the frame in a right hand bending state; and a rotational drive means to pivot the tool holder carriage and the supporting block together as an assembly in a first direction of rotation in the left hand bending state of the indexing means, and to pivot the tool holder carriage in a second direction of rotation opposite to the first direction of rotation in the right hand bending state of the indexing means.

2. The bending machine as claimed in claim 1, wherein:

the supporting block is pierced with two bores passing there through, said two bores each being arranged in coaxial registration with an axis of one of said two bending rollers, the tool holder carriage is carried by a first rotating shaft extending into one of the two bores of the supporting block and is provided, at an end opposite said tool holder carriage, with a first rotational drive pinion, the supporting block is attached to the frame via a second rotating shaft extending into the second bore of said supporting block and mounted in bearings secured to said frame, said shaft being provided with a second rotational drive pinion, and the means for driving in rotation the tool holder carriage and the supporting block together as an assembly and the tool holder carriage drive the first and second rotational drive pinions of said rotating shaft and said shaft in rotation.

3. The bending machine as claimed in claim 1, wherein the indexing means comprises a finger housed in a bore provided in the supporting block, and a means for moving said finger to engage said supporting block either with the tool holder carriage or with a part secured to the frame.

4. The bending machine as claimed in claim 1, further comprising two guide strips positioned upstream from the bending rollers and provided with supporting surfaces between which the profile to be bent passes, said guide strips being associated with a means for longitudinal movement which alternately straightens and guides the rod, bar, tube, or wire according to a bending direction.

5. The bending machine as claimed in claim 1, wherein:

the bending rollers have at least two grooves one above the other, each of said two grooves deforming the profile with different cross sections, vertical means for moving the supporting block to position said supporting block in such a way that one of said at least two grooves is disposed in a plane coplanar with an axis of movement of the profile.

6. The bending machine as claimed in claim 1 wherein the means for moving the profile longitudinally includes a clamp to grip the rear end of said profile, wherein said clamp includes two devices to guide and hold the profile, said two devices being disposed on either side of an axis of movement of said profile upstream from the bending rollers, said two devices being associated with elastic means to allow said two devices to retract transversely in contact with the clamp.

7. The bending machine of claim 2, wherein:

the first and second pinions of the first and second rotating shafts are arranged so as to intermesh, and the rotational drive means includes a toothed wheel arranged so as to mesh with the second pinion of the second rotating shaft.

8. The bending machine as claimed in claim 7, wherein the supporting block is pivotably mounted with respect to wings of a clevis-shaped part forming a bending head with said supporting block, the frame of said bending machine including detachable means for securing said bending head.

9. The bending machine as claimed in claim 8, wherein the detachable means for securing the bending head include two crank pins associated with means for moving said two crank pins longitudinally relative to the frame of said bending machine, said means for moving said two crank pins causing a core of the clevis-shaped part of said bending head to be pressed against said frame, and means for rapidly connecting fluids and electricity to said bending machine.

10. The bending machine as claimed in claim 9, wherein the clevis-shaped part of the bending head has a core with a thickness which is a function of the distance between axes of the first and second rotational drive pinions of the first and second rotating shafts, said second pinion of the second rotating shaft meshing with the toothed wheel secured to the frame.

11. The bending machine as claimed in claim 4, wherein the two guide strips ensure gripping of the profile, and the means for moving said two guide strips longitudinally exerts a thrusting force to compress the profile as the profile is moved in translation as a result of a pivoting of the bending rollers.

12. The bending machine as claimed in claim 4, further comprising means for the transverse movement of the two guide strips to move said two guide strips transversely relative to a longitudinal axis of the profile between a closed position and a separated position where said two guide strips are held apart at a distance so as to support the profile, or to permit the passage of the means for moving the profile.

13. The bending machine as claimed in claim 4, wherein each of said two guide strips is provided with a spigot housed in a clevis inside which are disposed elastic means arranged so as to tension said spigot in such a way as to permit travel of each of said guide strips on either side of a plane passing through the axis of longitudinal movement of the profile.

14. The bending machine as claimed in claim 5, wherein the vertical means for moving the supporting block positions said supporting block in a retracted position, wherein the bending rollers are disposed in such a way as to permit a rotation of said bending rollers relative to the profile.

15. A bending head mountable in a detachable manner on a frame of a bending machine, said bending head comprising:

two bending rollers mounted on a tool holder carriage and provided with supporting surfaces between which the profile to be bent is passed, gripped, and rolled;

a supporting block for the tool holder carriage, wherein said tool holder carriage is pivotably mounted about an axis of rotation coaxial with the axis of one of the two bending rollers, said supporting block being pivotably mounted about an axis of rotation coaxial with the axis of the other of the two bending rollers inside a clevis-shaped part which can be secured in a detachable manner to the frame of the machine;

an indexing means to lock in rotation either the tool holder to the supporting block in a left hand bending state, or to lock the supporting block and the clevis-shaped part, in a right hand bending state; and a rotational drive means to pivot the tool holder carriage and the supporting block together as an assembly in a first direction of rotation in the left hand bending state of the indexing means, and to pivot the tool holder carriage in a second direction of rotation opposite to the first direction of rotation in the right hand bending state of the indexing means.

* * * * *